United States Patent [19]

Bliss

[11] 3,979,019

[45] Sept. 7, 1976

[54] DISPENSING CLOSURE FOR TISSUE CARTON

[75] Inventor: Robert A. Bliss, St. Paul, Minn.

[73] Assignee: Hoerner Waldorf Corporation, St. Paul, Minn.

[22] Filed: Aug. 7, 1975

[21] Appl. No.: 602,789

[52] U.S. Cl. ..... 221/48

[51] Int. Cl.[2] ..... B65H 1/04

[58] Field of Search ..... 221/63, 48, 47; 229/17 R, 7, 38

[56] References Cited

UNITED STATES PATENTS

| | | | |
|---|---|---|---|
| 3,239,097 | 3/1966 | Bates et al. | 221/48 |
| 3,424,367 | 1/1969 | Desmond et al. | 229/38 |

*Primary Examiner*—Stanley H. Tollberg
*Attorney, Agent, or Firm*—Jerry F. Best

[57] ABSTRACT

A carton for use in dispensing interleaved tissues which is designed to leave each succeeding tissue in position partially withdrawn from the dispenser after the prior tissue has been completely removed. A conventional four panel end closure is provided with an outer panel covering the entire surface of the end of the carton, with two first-folded minor flaps having film attached thereto so that in the final folded position an aperture results, with the overlapping film covering that aperture from below. An overwrap is provided which is glued on the bottom side of the carton and attached to the top side to a removable panel formed as a part of the top flap and removable to expose the entire aperture.

6 Claims, 7 Drawing Figures

DISPENSING CLOSURE FOR TISSUE CARTON

BACKGROUND OF THE INVENTION

1. Field of the Invention

This invention relates to cartons for dispensing tissues and to film overwrap arrangements for sealing the aperture prior to opening by the consumer.

2. Description of the Prior Art

Packages for dispensing interleaved tissues for personal use are quite numerous. The use of two overwrapping pieces of film to define the aperture through which the tissues are removed is a desirable technique since the tissue which is removed pulls the trailing tissue partly through the opening and the pressure of the two overlapping pieces of film holds it in place so that it may be easily grasped by the user for removal. Examples of this are shown in U.S. Pat. No. 2,573,309 to Chipkevich, issued Oct. 30, 1951. More recently it has become desirable from a marketing standpoint to add this feature to a paperboard carton which may be used as a decorative item with art work or other information printed on the carton. U.S. Pat. No. 3,239,097 to Bates et al., issued Mar. 8, 1966, shows such a carton but it should be noted that the two overlapping pieces of film seen in FIG. 4 are attached to a single panel 36. To produce such a carton would require that the blank be passed through two turns in a windowing machine, or film applicator device, since one piece of film must be laid on top of the other. There is a need for a design which eliminates this manufacturing problem, and yet is attractive, simple to manufacture, and inexpensive.

SUMMARY OF THE INVENTION

A tissue dispenser carton with one end having two inwardly foldable minor closure flaps, each of which having plastic film attached to the underside thereof covering die cut portions in each flap which combine to form an opening on the top of the carton, with additional flaps including an outer covering flap having a cooperating aperture through which the tissues may be removed.

DETAILED DESCRIPTION OF THE PREFERRED EMBODIMENT

The particular technique of using two pieces of flexible film, either in abutting relationship or in a slight overlap relationship in order to hold each tissue in succession in an upright, easy to grasp manner is not new and has become routine over the last few years. The present invention discloses a carton which employs two pieces of film on separate flaps which fold together in general abutting relationship and have portions die cut therefrom which result in an aperture being formed between the two flaps. The particular embodiment which is shown illustrates the film in an overlapped arrangement, but it should be understood that an abutting arrangement might, in some circumstances, work equally as well.

Figure 1:
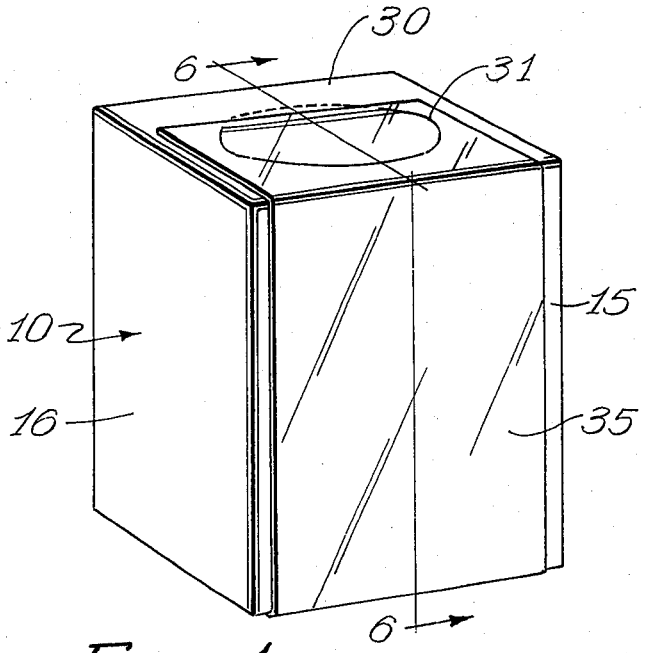
FIG. 1 is a perspective view showing a completed and assembled carton embodying the present invention.
Figure 7:
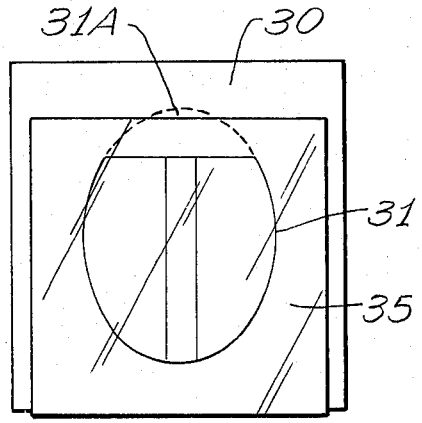
FIG. 7 is a top plan view of the carton shown in FIG. 1 illustrating the relationship between the outer film, the removable panel to which it is attached, and the overlapped film strips underneath.
Figure 2:
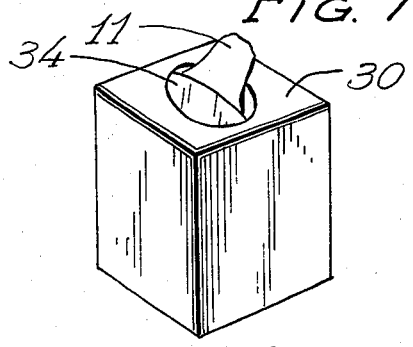
FIG. 2 is a perspective of the carton shown in FIG. 1 with the outer wrapper removed illustrating the retention of each tissue in its partially removed mode.

The container is shown generally in FIG. 1 as 10 and contains a stack of interleaved tissues 11 which, when one is removed, pulls the next succeeding tissue along with it. The carton is made from a blank of foldable paperboard or similar sheet-like material which is shown generally as 12 in FIG. 3. The blank 12 includes four side wall panels 13, 14, 15 and 16, which are connected by three vertically oriented parallel fold lines 17, 18 and 19 respectively. These four side walls are foldable into a tube-like configuration which is rectangular in cross section and may be joined by any conventional manufacturer's joint, with the particular joint illustrated in FIG. 3 being a glue flap 20 attached to one lateral edge of the blank along a fold line 21.

The bottom edge of each of the four wall panels 13, through 16 is defined by horizontal fold line 22 which serves to connect bottom closure flaps 23, 24, 25 and 26 to each of the respective side walls. The exact configuration of this bottom closure may be varied and is not a claimed feature in this invention. The top closure consists of four flaps which are arranged along the top edges of the respective side walls and are hingedly connected along the fold line 27 to first inwardly folded flaps 28 and 29 are connected on opposite side walls such that when the blank is folded they are in abutting relationship with one another, and have die cut areas 28A and 29A removed from the top edges thereof, which in the particular embodiment shown cooperate in folded position to form a generally oval aperture. Located between the two first folded flaps is a major outer or cover flap 30 which has a die cut opening 31 formed therein which is formed in shape substantially similar to the aperture created by the two cooperating first folded flaps 28 and 29. A portion 31A is left in position within the aperture and connected to the flap 30 by a weakened line of separation 32 so that it may be easily removed. An outer film wrapper may be attached to this which will be described later. At the top edge of the remaining side wall panel is an optional fourth flap 33 which may be inwardly folded below the cover flap 30 and which must have formed as a part thereof a die cut area 33A which lies in cooperating relationship with the other die cut openings to give alignment and an accurately defined aperture on the top of the carton.

Figure 3:
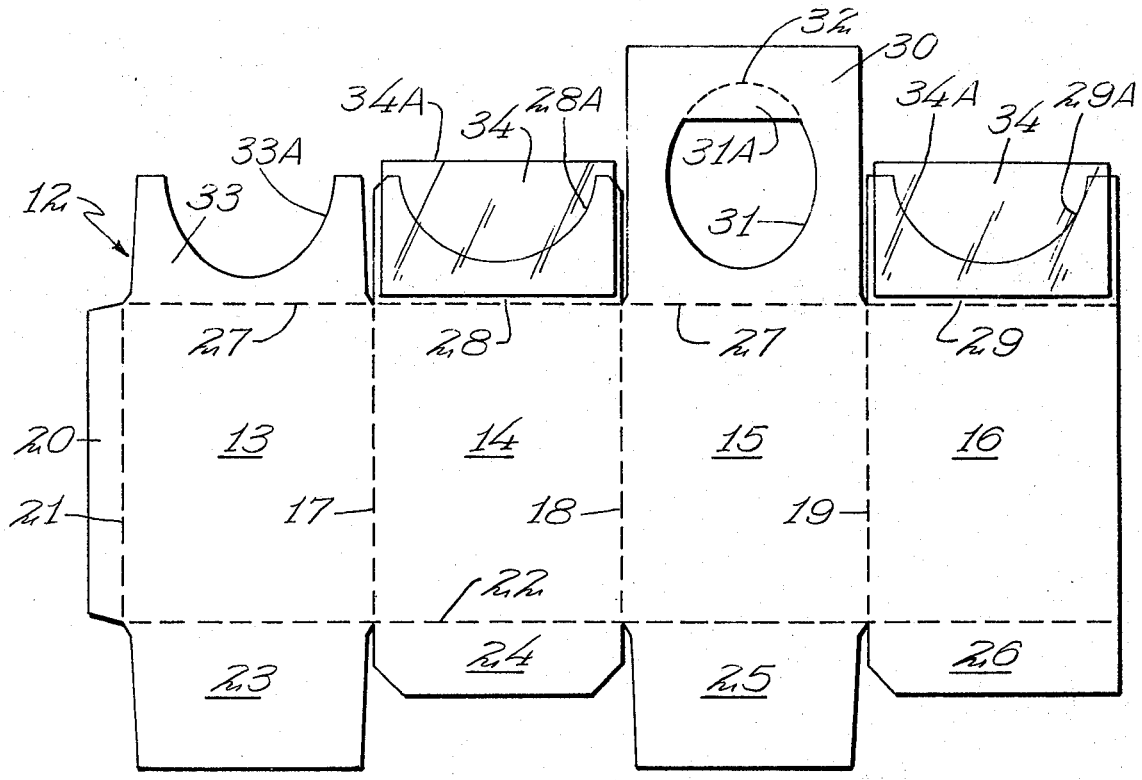
FIG. 3 is a plan view of the inside surface of a blank adapted to be erected into a carton similar to that shown in FIG. 1.

It can be seen on the blank of FIG. 3 that the two inwardly folded flaps 28 and 29 have pieces of film 34 adhesively attached to the underside thereof, and this may be accomplished by processing the blank through a film applying machine only one time by directing the blank through the machine in the direction parallel to the fold line 27, the overlap of the film obtained by dimensioning the height of the inside edges 34A of the film from the fold line 27 a distance slightly greater than one half the width of the carton. It is possible to locate the pieces of film on the side of the flaps 28 and 29 which will be outermost in the final folded position, and the film is illustrated as being on the inside of the flaps since it is believed that improved tension results when the film 34 is so placed.

Figure 5:
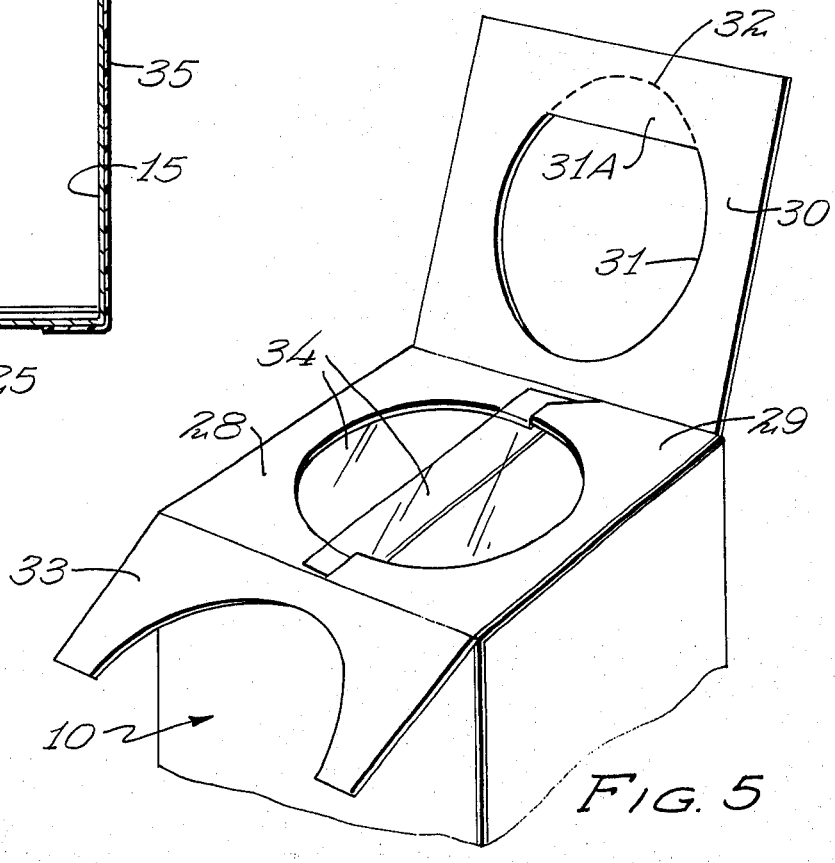
FIG. 5 is a perspective view of the carton shown in FIG. 4 with the inner flaps folded showing the overlap of the two pieces of film.
Figure 4:
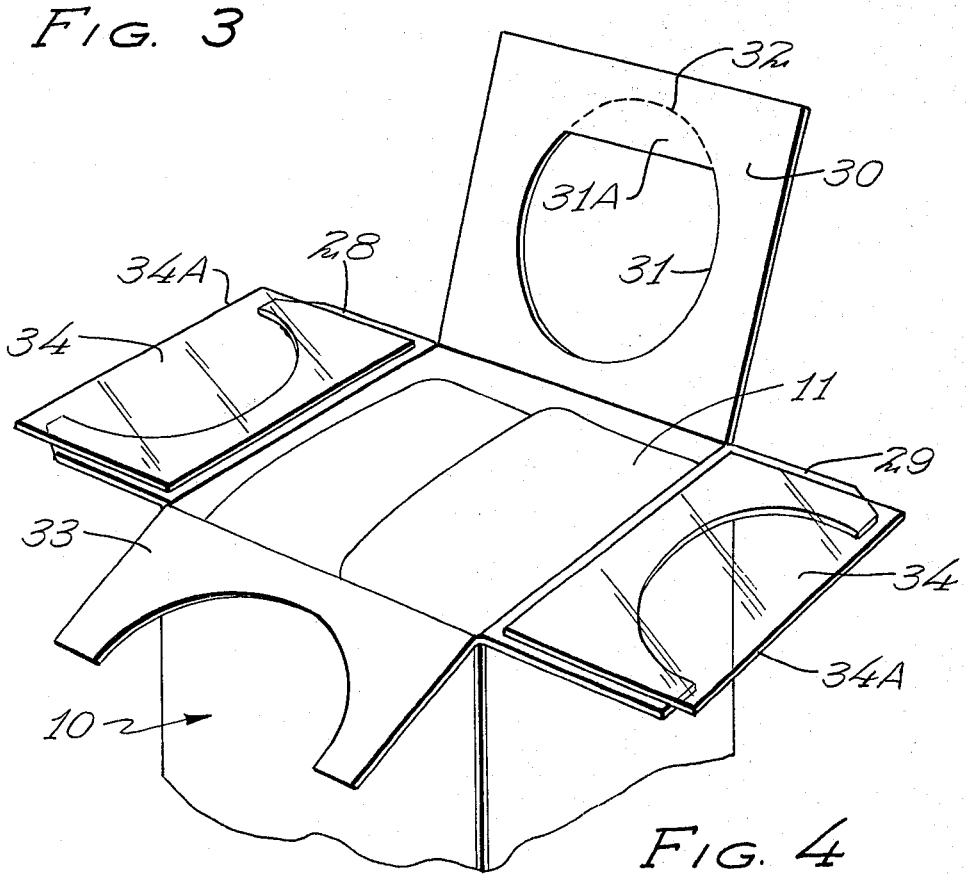
FIG. 4 shows the blank of FIG. 3 assembled in tubular form and filled with tissues prior to folding of the end closures which embody the present invention.

FIG. 4 illustrates the arrangement of the four flaps prior to folding, and illustrates the position of the carton 10 when the stack of interleaved tissues 11 is placed therein. From the position shown in FIG. 4 the three minor flaps are folded together, and the illustration in FIG. 5 shows the overlapped relationship of the two pieces of film 34 prior to folding the third minor flap 33 on top thereof. As mentioned, the third minor flap 33 need not be included at all, but it has been found that additional rigidity is obtained in the top structure if it is folded on top of the two minor flaps 28 and 29, and it should be understood that no additional board is used in the blank by virtue of the inclusion of that flap 33. The cover flap 30 is folded on top of the three flaps and the pattern of application of adhesive may be varied, so long as the film strips 34 extending across the aperture, which will be numbered 31 for ease of understanding in FIGS. 1, 2, 6 and 7, are not affixed to one another, and similarly so that the removable panel 31A may be broken loose along the weakened line of separation 32 and lifted from the aperture 31.

Figure 6:
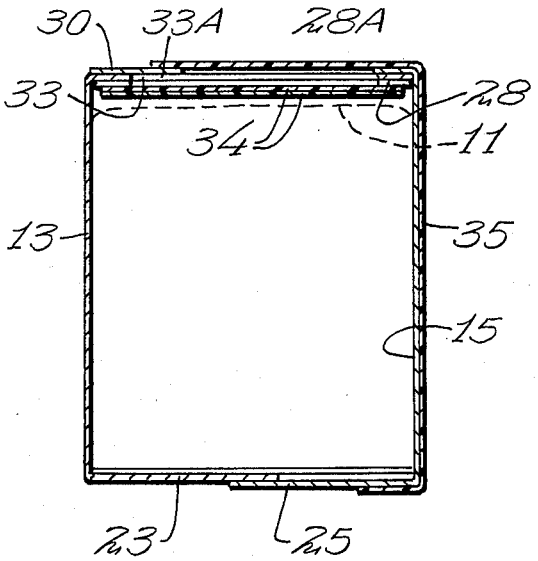
FIG. 6 is a side elevation section view taken along section line 6—6 in FIG. 1.

In the particular embodiment shown, an outer wrapper of flexible film such as polyethylene or the like 35 is located on one side in the top of the carton 10 and is adhesively attached along the bottom of the carton as may be seen in FIG. 6. Its opposite end is attached to the removable portion 31A located in the aperture 31 so the contents of the box 10 may then be viewed by the consumer in the store, yet the contents are kept clean and dust free by the film 35. At the same time it is easily removable by pressing down on the removable section 31A with the thumb and tearing the film away. The means for closing the box may be of the more conventional variety where the film 35 is omitted and the insert 31A is enlarged to cover the entire aperture 31 prior to removal. The advantage to using the film 35 is that customer information may be printed thereon for purposes of sales information in the stores, and yet once it is removed the other art work on the box will remain and present a more attractive package.

I claim:

1. A dispensing carton for tissues made from foldable sheet material having four side walls connected in rectangular tube-like configuration, means closing the bottom end of the box, and a stack of interleaved tissues disposed therein, said carton having a top dispensing closure comprising:

a pair of first folded flaps, one of said first folded flaps being hingedly connected along the top edges of each of two opposing side walls, said first folded flaps extending substantially one half the distance across the end of said carton and positioned in substantially abutting relationship with one another;

each of said first folded flaps having a die cut area removed therefrom creating a cooperating aperture for purposes of withdrawing said tissues from said carton;

each of said first folded flaps having adhesively attached thereto and covering at least said removed area a piece of flexible film, each of said strips having an inside edge positioned at approximately the midpoint of said carton;

a cover flap formed in size substantially equal to the end of said carton and hingedly attached to one of the remaining two side walls and foldable downwardly into overlapping relationship with said first folded flaps, said cover flap having an aperture formed therein and adapted to lie in juxtaposition with the opening created by the two abutting die cut areas in said first folded flaps and covered by said film strips.

2. The carton of claim 1, wherein said inside edges of said film strips attached to said first folded flaps are arranged in overlapping relationship.

3. The carton of claim 1 including a panel covering at least a portion of said aperture and attached to said cover flap by a weakened line of separation.

4. The carton of claim 3, including a piece of film covering one of said side walls and adhesively attached to the bottom of said carton adjacent to said side wall which said film covers, said film also covering substantially all of said die cut aperture in said cover flap and attached to said insert panel so that when said insert panel is removed said film cover may be torn away to provide access to said tissues in said carton.

5. A blank made of foldable sheet material and adapted to be erected into a carton for dispensing interleaved tissues, said blank comprising:

four rectangular side wall panels in side-by-side relationship hingedly connected along parallel vertical fold lines;

means attached to either lateral side of said blank for closing said blank in tubular relationship;

closure flaps attached to the bottom edges of said side walls to provide a bottom closure for said carton;

a cover panel hingedly connected along the top edge of one of said side walls formed in height substantially equal to the width of the side walls adjacent thereto, and having a die cut aperture formed therein;

minor flaps hingedly attached to side walls adjacent to said cover panel, each of said minor flaps having die cut portions removed from the top edge thereof; and a strip of plastic film adhesively attached to each of said first foldable flaps covering at least the die cut opening therein.

6. The blank of claim 5, including an insert panel located within said aperture in said cover panel, said insert panel attached to said cover flap along a weakened line of separation and formed in size to cover at least a portion of said aperture.

* * * * *